US011035259B2

(12) United States Patent
Sonnek et al.

(10) Patent No.: US 11,035,259 B2
(45) Date of Patent: Jun. 15, 2021

(54) METHOD AND SYSTEM FOR STACK HEAT RECOVERY

(71) Applicants: Daniel W. Sonnek, Lake Crystal, MN (US); Gregory W. Loest, Utica, SD (US)

(72) Inventors: Daniel W. Sonnek, Lake Crystal, MN (US); Gregory W. Loest, Utica, SD (US)

( * ) Notice: Subject to any disclaimer, the term of this patent is extended or adjusted under 35 U.S.C. 154(b) by 308 days.

(21) Appl. No.: 16/364,373

(22) Filed: Mar. 26, 2019

(65) Prior Publication Data

US 2019/0292949 A1 Sep. 26, 2019

Related U.S. Application Data

(60) Provisional application No. 62/648,068, filed on Mar. 26, 2018.

(51) Int. Cl.

| | |
|---|---|
| ***F01K 23/10*** | (2006.01) |
| ***F22B 1/18*** | (2006.01) |
| ***F22B 1/16*** | (2006.01) |

(52) U.S. Cl.

CPC ..... *F01K 23/10* (2013.01); *F22B 1/16* (2013.01); *F22B 1/18* (2013.01)

(58) Field of Classification Search

CPC ..... F01K 23/10

See application file for complete search history.

(56) References Cited

U.S. PATENT DOCUMENTS

| | | | |
|---|---|---|---|
| 4,447,964 | A | 5/1984 | Gardner |
| 4,615,122 | A | 10/1986 | Sherrod et al. |

(Continued)

FOREIGN PATENT DOCUMENTS

| | | | |
|---|---|---|---|
| CN | 2656474 | Y | 11/2004 |
| CN | 102435016 | A | 5/2012 |

(Continued)

OTHER PUBLICATIONS

Hazi, A., et al., "Energy Savings Through Heat Recovery Systems in the Papermaking", Bulletin of the Transilvania University of Braşov • vol. 2 (51)—2009 • Series I, pp. 355-358.

(Continued)

*Primary Examiner* — Nathaniel Herzfeld

(74) *Attorney, Agent, or Firm* — Fox Rothschild LLP

(57) ABSTRACT

A method of recovering heat from an exhaust stream during a manufacturing process is provided. The method includes providing a condensing heat exchanger having a first side with cold recirculation water and a second side; passing an exhaust stream of vapors having a temperature of 500 degrees F. or less into the heat exchanger through the second side. Heat from the exhaust stream is transferred to the first side of the condensing heat exchanger and the vapors are thus cooled to the dew point to cause condensation. The condensation is collected in a condensate tank where an amount recovered is from 20% to 75%. The condensate water is transferred to a flash tank and used to adjust the volume of the recirculation water routed thereto. External make-up water is input into the flash tank but is reduced by the amount of condensate water recovered by the heat stack recovery system.

10 Claims, 1 Drawing Sheet

(56) References Cited

U.S. PATENT DOCUMENTS

| | | | | |
|---|---|---|---|---|
| RE33,082 | E * | 10/1989 | Gerstmann | F24D 11/005 122/20 B |
| 9,989,310 | B2 | 6/2018 | Knight, Jr. et al. | |
| 10,010,810 | B1 * | 7/2018 | Jeong | F22B 15/00 |
| 10,345,043 | B2 | 7/2019 | Knight, Jr. et al. | |
| 2004/0079088 | A1 * | 4/2004 | Hayakawa | F02G 5/00 60/784 |
| 2006/0076428 | A1 * | 4/2006 | Knight | F22D 1/36 237/19 |
| 2006/0194159 | A1 * | 8/2006 | Franz | F28F 3/083 431/11 |
| 2010/0269996 | A1 | 10/2010 | Grattan et al. | |
| 2011/0277340 | A1 | 11/2011 | Wien et al. | |
| 2011/0277633 | A1 | 11/2011 | Sonnek et al. | |
| 2012/0021310 | A1 * | 1/2012 | Saito | F28F 19/02 429/414 |
| 2013/0025294 | A1 * | 1/2013 | Vogel | B01D 53/002 62/3.1 |
| 2014/0325869 | A1 | 11/2014 | Jensen | |

FOREIGN PATENT DOCUMENTS

| | | | |
|---|---|---|---|
| EP | 0927703 | A2 | 7/1999 |
| WO | WO2010094913 | A2 | 8/2010 |
| WO | WO2015176570 | A1 | 11/2015 |

OTHER PUBLICATIONS

Paffel, Kelly, "Flash Steam Recovery from Non-Modulating Steam Applications", Pumps & Systems, Mar. 9, 2012, 12 pages.

Swagelok Energy Advisors, Inc., "Steam Thermocompressor Systems", Steam Systems Best Practices, Document No. 44, Jun. 2013, 4 pages.

U.S. Department of Energy, Advanced Manufacturing Office, "Improving Steam System Performance: A Sourcebook for Industry", Second Edition, DOE/GO-102012-3423 • Revised Oct. 2012, 64 pages.

U.S. Department of Energy, Advanced Manufacturing Office, "Use Steam Jet Ejectors or Thermocompressors to Reduce Venting of Low-Pressure Steam", Energy Tips: Steam, Steam Tip Sheet #29, DOE/GO-102012-3414 • Jan. 2012, 2 pages.

* cited by examiner

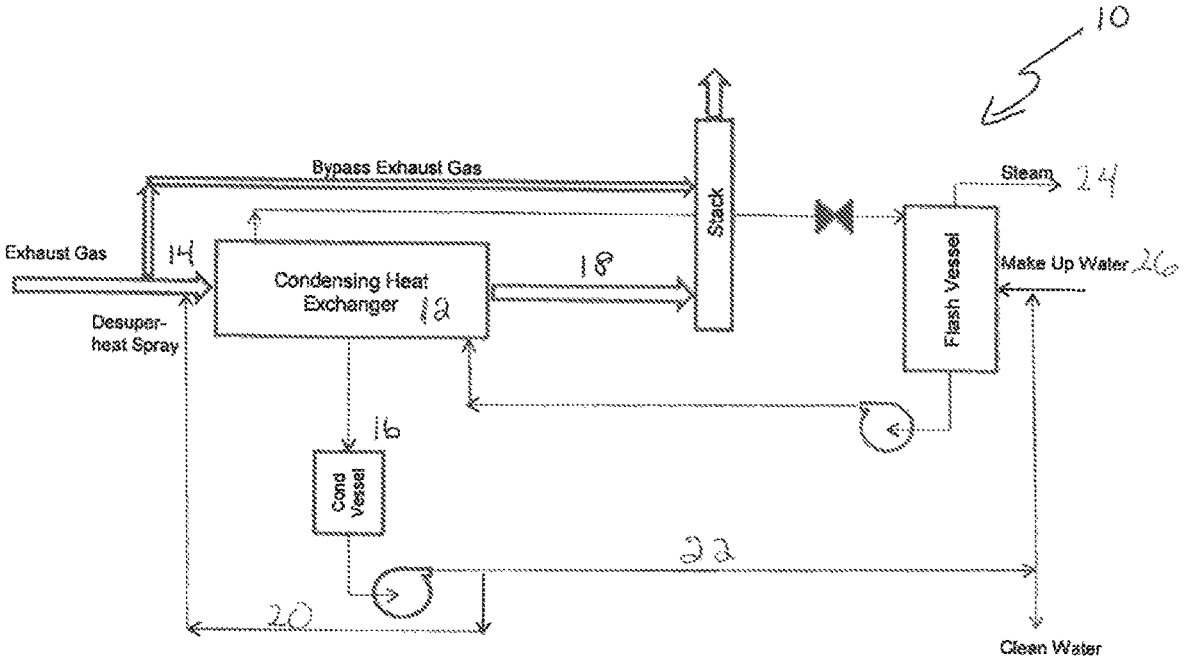
10
Bypass Exhaust Gas
Stack
Steam
24
Exhaust Gas
14
Condensing Heat Exchanger
12
18
Flash Vessel
Make Up Water
26
Desuper-heat Spray
16
Cond Vessel
22
20
Clean Water

METHOD AND SYSTEM FOR STACK HEAT RECOVERY

CROSS REFERENCE TO RELATED APPLICATIONS

This application claims the benefit of U.S. provisional patent application Ser. No. 62/648,068, filed on Mar. 26, 2018; the entirety of which is incorporated by reference herein.

FIELD OF THE INVENTION

The present invention is generally directed to the recovery of heat from chimneys or stacks. More particularly, the present invention is directed to an improved process for heat recovery during manufacturing processes of a variety of products.

BACKGROUND OF THE INVENTION

Many industries employ heating material to drive moisture from a product during the manufacture of the product. This moisture is carried away with hot air and is typically discharged up a chimney or stack and is emitted into the atmosphere. In many processes, however, this moisture laden exhaust is not suitable for direct emission and must be treated to remove volatile organic compounds ("VOCs") and other pollutants.

Thermal oxidizers are one method for reducing these pollutants. They easily destroy 95 percent or more of the VOCs delivered to them, require little labor and can be monitored for compliance simply and cheaply. A thermal oxidizer raises the temperature of the exhaust to a high enough level that the pollutants are burned or oxidized and reduced to elemental compounds.

However, there is still vapors that have been processed by the thermal oxidizers with energy that is wasted up the exhaust. Therefore, what is needed is a new method and system that recovers heat from an exhaust stream during a manufacturing process to improve overall efficiency, allowing for energy produced by the system that can be added back into the process with no additional external energy needed to be input.

BRIEF DESCRIPTION OF THE DRAWINGS

For a better understanding of the invention, and to show how the same may be carried into effect, reference will now be made, by way of example, to the accompanying drawings, in which:

FIG. 1 is a process flow diagram of the present invention using a condensing heat exchanger.

DETAILED DESCRIPTION OF THE INVENTION

Referring now to FIG. 1 a process flow diagram of the heat stack recovery system 10 in accordance with the invention that utilizes a condensing heat exchanger 12 is depicted. The present invention recovers energy from an exhaust stream during manufacturing processes such as thermal oxidizer discharge and regenerative thermal oxidizer discharge and inputs it back into the manufacturing process from which it extracted or used in other processes within the plant. Exhaust streams during manufacturing processes consist primarily of nitrogen, carbon dioxide, a small amount of oxygen and trace amounts of ash. Because the exhaust stream 14 is at a temperature of typically less than 500 degrees F. and is moisture laden, a condensing heat exchanger 12 is employed. This heat exchanger 12 has relatively cold recirculation water on one side of the tubes or plates while the hot exhaust or vapor stream passes the other side of the tubes or plates. The energy is transferred from the hot exhaust 14 to the cold recirculation water; thus cooling the exhaust vapors. Once the vapor temperature has dropped to the dew point, condensation takes place and is collected into the condensate tank 16. The cooled exhaust is then sent to its normal discharge stack 18.

The condensate is typically ultra-pure due to the distillation of the water from the dryers as well as passing through thermal oxidation that removes contaminants. However, it is also low pH due to the acidic nature of the combustion products. Because of the water purity, it can be easily pH-adjusted with a base to bring the pH above neutral, i.e. 7.0 pH, to prevent any corrosion of system components. The condensate can also be sprayed back into the hot exhaust stream to drop the temperature to dew point more quickly 20 and/or be used as make up water to the flash tank 22.

The condensing heat exchanger recovers heat energy via exhaust temperature and condensing of the water in the exhaust stream. This heat energy is absorbed by the water stream inside the heat exchanger. The water stream including the heat energy is called recirculation water. Recirculation water is pumped from and back to a low pressure flash vessel. The flash vessel receives the heated recirculation water and flash cools it. The cooled recirculation water is then returned to the heat exchanger to recover more heat. The steam flashed in this vessel is routed to a suitable part of the process to offset steam produced by other sources.

As discussed above, the recirculation water is pumped from the flash tank to the condensing heat exchanger where it recovers heat, picks up energy and its temperature rises. It then returns to the flash tank where it is at a higher temperature than can be maintained in the pressure of the tank. A portion of the recirculation water flashes off as low pressure steam 24 (evaporates); giving off energy necessary to lower the remaining recirculation water temperature to an equilibrium point that matches the pressure of the flash tank. This cooled recirculation water is then pumped back to the condensing heat exchanger to extract more heat.

The low pressure steam that is produced by the flash tank is used in other parts of the plant or in the process in accordance with the invention. As this steam exits the system, water has been removed from the recirculation water and must be made up to maintain a constant volume. The pi-adjusted condensate from the condensate tank is used for this purpose. If there is additional external make-up water 26 is required, existing plant boiler make-up water, external to the heat recovery system is used. Those of skill in the art will appreciate that external make-up water is expensive. Because the system in accordance with the invention uses condensate water to maintain a constant volume of recirculation water, it decreases the amount of external make-up water that is required over conventional systems by 20% to 75% as hereinafter described.

The condensed water is collected in a receiver tank. As previously disclosed the condensed water is typically ultra-pure to very clean (i.e. boiler quality water) due to the flashing process of the dryer—distillation—and the thermal oxidation process that destroys any contaminants that would be driven off by the drying and carried with the exhaust gases. Because of the purity of the water, it is typically at a low pH due to the carbon dioxide that is present in both the dryer and thermal oxidizer. Water at a low pH is typically corrosive to the equipment it comes into contact with. Therefore, the pH may be adjusted to neutral in the receiver tank and can then be filtered if ash is present. A portion of the water and/or condensate stream is sprayed via a fine-spray nozzle in the exhaust gas stream prior to the condensing heat exchanger to lower the vapor temperature to help fully saturate the stream to increase the effectiveness of the exchanger. By fully saturate we means 100% relative humidity. If the vapor stream is at 100% relative humidity, the heat exchanger must remove the sensible heat to get to 100% relative humidity. Once at this point, latent heat—phase change can take place. Latent heat can transfer much more energy per unit area than can sensible heat. Any condensate not used to cool the vapors can be directed to the flash tank make up as described below.

Condensate recovery can vary from 20% to 75% of the steam produced. This variability is due to the water-absorption properties of exhaust vapors from differing combustion processes. For example, the combustion processes employed in conventional systems can be operated in ways that can produce constituent levels in the exhaust vapors—particularly with regard to oxygen ($O_2$) and nitrogen ($N_2$). As the $O_2$ is decreased, the $N_2$ increases. This changes the point at which water will condense from the exhaust vapors. In atmospheric air (oxygen at 21%, nitrogen at 78%, and carbon dioxide <1%), water will begin to condense at 210-212 F. After combustion, (oxygen at 2% and nitrogen at 86%, and carbon dioxide at 11%), water will not condense readily until the temperature falls below 175 F.

The combustion processes differ in the amount of excess oxygen allowed thus dictating the final nitrogen levels. The condensate produced is reduced as the condensing temperature drops. These are all physical characteristics of variable gas compositions. Heat sink temperatures (flash tank), circulation water rates, etc. can and will vary at each installation location of the heat recovery system in accordance with the invention thus varying the amount of recovery of the condensate, which in turn drives the reduction in the amount of external make-up water required.

Example I

A combustion process used in the stack heat recovery system uses 15% oxygen, 80% nitrogen, 212 degrees F. at 100% relative humidity (6800 gr/lb of water) into the stack heat recovery system in accordance with the invention. This results in an output of 15% oxygen, 80% nitrogen, 175 degrees F. at 100% relative humidity (2400 gr/lb of water). The yield of condensate is (6800 gr/lb-2400 gr/lb) divided by 6800 gr/lb equals 65% water condensate recovery. The condensate water is treated with a base to increase the pH to approximately 7.0. The condensate is then routed to the flash vessel to increase or adjust the recirculation water by the volume of steam evaporated thereby using 65% less external make-up water to adjust the volume of the recirculation water.

Example II

A combustion process used in the stack heat recovery system uses 2% oxygen, 86% nitrogen, 212 degrees F. at 100% relative humidity of 6800 gr/lb of water. This results in an output of 2% oxygen, 86% nitrogen, 175 F at 100% relative humidity or 5400 gr/lb of water. This yields (6800 gr/lb-5400 gr/lb)+6800 gr/lb equals 21% water condensate recovery. The condensate water is treated with a base to increase the pH- to approximately 7.0. The condensate is then routed to the flash vessel to increase or adjust the recirculation water by the volume of steam evaporated thereby using and 21% less external make-up water is required.

Although the present invention has been described with reference to various aspects of the invention, those of ordinary skill in the art will recognize that changes may be made in form and detail without departing from the spirit and scope of the invention.

What is claimed is:

1. A method of recovering heat from an exhaust stream during a manufacturing process in a plant comprising:

providing a heat stack recovery system including a condensing heat exchanger, the condensing heat exchanger having a first side with cold recirculation water and a second side;

passing the exhaust stream into the heat exchanger through the second side, wherein the exhaust stream comprises vapors and has a temperature of 500 degrees F. or less;

transferring heat from the exhaust stream to the first side of the condensing heat exchanger and cooling the vapors to the dew point to cause condensation;

collecting the condensation in a condensate tank;

recovering condensate water from the exhaust stream of from 20% to 75%;

sending the cooled exhaust to a discharge stack;

transferring the condensate to a flash tank to adjust a volume of the recirculation water routed thereto;

inputting a source of external make-up water into the flash tank, as needed, wherein the amount of external make-up water required in the flash tank is reduced by the amount of condensate water recovered by the heat stack recovery system.

2. The method of claim 1 wherein the exhaust stream includes one or more of nitrogen, carbon dioxide, oxygen and ash.

3. The method of claim 1 further comprising adjusting the condensate to a neutral pH to prevent corrosion of system components.

4. The method of claim 1 further comprising spraying the condensate back into the hot exhaust stream.

5. The method of claim 1 further comprising adjusting the pH of the condensate to a pH of 7.0.

6. The method of claim 1 further comprising producing heated recirculation water by the condensing heat exchanger and pumping the recirculation water to a flash vessel.

7. The method of claim 6 further comprising flash cooling the heated recirculation water, flashing off a portion of the heated recirculation as low pressure steam; producing cooled recirculation water from the remaining portion of the heated recirculation water.

8. The method of claim 7 further comprising using the low pressure steam in other parts of the plant.

9. The method of claim 7 wherein a portion of the condensate water is added to the cooled recirculation water to maintain a constant volume of recirculation water in the system.

10. The method of claim 9 further comprising transferring the cooled, adjusted volume of recirculation water back to the condensing heat exchanger.

* * * * *